US009047820B2

(12) United States Patent
Jeong et al.

(10) Patent No.: US 9,047,820 B2
(45) Date of Patent: Jun. 2, 2015

(54) ORGANIC LIGHT EMITTING DISPLAY AND METHOD OF DRIVING THE SAME

(75) Inventors: Jin-Tae Jeong, Yongin (KR); Oh-Kyong Kwon, Seoul (KR)

(73) Assignees: Samsung Display Co., Ltd., Yongin-si (KR); Industry-University Cooperation Foundation Hanyang University, Seoul (KR)

( * ) Notice: Subject to any disclaimer, the term of this patent is extended or adjusted under 35 U.S.C. 154(b) by 227 days.

(21) Appl. No.: 13/585,761

(22) Filed: Aug. 14, 2012

(65) Prior Publication Data

US 2013/0222348 A1 Aug. 29, 2013

(30) Foreign Application Priority Data

Feb. 28, 2012 (KR) ..... 10-2012-0020259

(51) Int. Cl.
*G09G 5/00* (2006.01)
*G09G 3/30* (2006.01)
*G09G 3/32* (2006.01)

(52) U.S. Cl.
CPC ..... *G09G 3/3233* (2013.01); *G09G 3/3266* (2013.01); *G09G 3/3291* (2013.01); *G09G 2300/0819* (2013.01); *G09G 2300/0842* (2013.01); *G09G 2300/0861* (2013.01); *G09G 2310/0202* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 5,881,202 | A * | 3/1999 | Herz | 386/263 |
| 2005/0007319 | A1* | 1/2005 | Shin et al. | 345/76 |
| 2007/0122131 | A1* | 5/2007 | Hirai | 396/52 |
| 2010/0103156 | A1* | 4/2010 | Yamashita et al. | 345/211 |
| 2011/0090200 | A1 | 4/2011 | Choi et al. | |
| 2012/0050233 | A1* | 3/2012 | Choi et al. | 345/204 |

FOREIGN PATENT DOCUMENTS

| | | |
|---|---|---|
| KR | 10-2008-0009417 A | 1/2008 |
| KR | 10-2011-0042516 | 4/2011 |

* cited by examiner

*Primary Examiner* — Christopher R Lamb
(74) *Attorney, Agent, or Firm* — Christie, Parker & Hale, LLP

(57) ABSTRACT

A method of driving an organic light emitting display capable of providing a sufficient (e.g., a sufficiently long) data writing period and/or threshold voltage compensating period is provided. The method includes supplying scan signals to odd scan lines in a writing period of an odd frame set to be in a non-emission state, and supplying scan signals to even scan lines in a writing period of an even frame set to be in the non-emission state.

8 Claims, 3 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2012-0020259, filed on Feb. 28, 2012, in the Korean Intellectual Property Office, the entire content of which is incorporated herein by reference.

BACKGROUND

1. Field

Aspects of embodiments of the present invention are directed to an organic light emitting display and a method of driving the same.

2. Description of the Related Art

In general, a semiconductor device includes a thin film transistor (TFT) and a capacitor. The TFT includes: a semiconductor layer for providing a channel region, and source and drain regions; a gate electrode on the channel region of the semiconductor layer and electrically insulated from the semiconductor layer by a gate insulating layer; and source and drain electrodes connected to the source and drain regions of the semiconductor layer. The capacitor includes two electrodes and a dielectric layer interposed between the two electrodes.

Among the flat panel displays (FPDs), the organic light emitting displays display images using organic light emitting diodes (OLEDs) that generate light by re-combination of electrons and holes. The organic light emitting display has high response speed and is driven with low power consumption.

The organic light emitting display includes a plurality of pixels arranged in a matrix at crossing regions of a plurality of data lines, scan lines, and power source lines. Each of the pixels includes an OLED, at least two transistors including a driving transistor, and at least one capacitor.

The above-described organic light emitting display has small power consumption. However, the amount of current that flows to the OLED varies between pixels in accordance with a variation in the threshold voltage of the driving transistor included in each of the pixels, thus causing a non-uniformity in the displayed images. In further detail, the characteristic of the driving transistor changes in accordance with a variance in the manufacturing process of the driving transistor included in each of the pixels. With current processes, it is not possible to make all of the transistors of the organic light emitting display have the same driving transistor characteristic. Accordingly, a variation between pixels in the threshold voltage of the driving transistor is generated.

SUMMARY

Aspects of embodiments of the present invention are directed to an organic light emitting display and a method of driving the same. More particularly, aspects are directed to an organic light emitting display capable of providing a sufficient (e.g., a sufficiently long) data writing period and/or threshold voltage compensating period, and a method of driving the same.

Further aspects of embodiments of the present invention are directed to an organic light emitting display capable of providing a sufficient (e.g., a sufficiently long) data writing period and/or threshold voltage compensating period when the organic light emitting display is driven by a concurrent (e.g., a simultaneous) driving method, and a method of driving the same.

In an exemplary embodiment of the present invention, an organic light emitting display is provided. The organic light emitting display includes a scan driver and a data driver. The scan driver is for supplying scan signals to odd scan lines in a writing period of an odd frame where pixels are set to be in a non-emission state, and for supplying scan signals to even scan lines in a writing period of an even frame where the pixels are set to be in the non-emission state. The data driver is for supplying data signals corresponding to the odd scan lines in the writing period of the odd frame, and for supplying data signals corresponding to the even scan lines in the writing period of the even frame.

The organic light emitting display may further include a data arranging unit for receiving two contiguous frames of first data, for generating one frame of second data using the two contiguous frames of the first data, and for supplying the generated second data to the data driver.

The data arranging unit may be configured to supply the second data corresponding to the odd scan lines to the data driver in the writing period of the odd frame, and to supply the second data corresponding to the even scan lines to the data driver in the writing period of the even frame.

The data arranging unit may be configured to generate the one frame of the second data by averaging the two contiguous frames of the first data.

The data arranging unit may be configured to select one frame of the two contiguous frames of the first data as the one frame of the second data.

Each of the pixels may be set to be in the non-emission state when emission control signals are supplied to emission control lines, and may be set to be in an emission state when the emission control signals are not supplied.

The organic light emitting display may further include an emission control line driver for supplying the emission control signals to the emission control lines in the writing periods of the odd frame and the even frame, and for not supplying the emission control signals to the emission control lines in emission periods of the odd frame and the even frame.

According to another exemplary embodiment of the present invention, a method of driving an organic light emitting display is provided. The method includes: supplying scan signals to odd scan lines in a writing period of an odd frame set to be in a non-emission state; and supplying scan signals to even scan lines in a writing period of an even frame set to be in the non-emission state.

The method may further include: supplying data signals corresponding to the odd scan lines in the writing period of the odd frame; and supplying data signals corresponding to the even scan lines in the writing period of the even frame.

Each of the pixels may emit light during an emission period of each of two contiguous frames to correspond to a respective data signal supplied during the writing period of a first of the two contiguous frames.

In organic light emitting displays according to embodiments of the present invention, since the odd scan lines and the even scan lines are alternately driven in each frame, a sufficient line time (for example, to secure appropriate charges in the pixel circuit capacitors for data writing and/or threshold voltage compensation) of each of the scan lines may be provided. Therefore, in methods of driving the organic light emitting display according to embodiments of the present invention, it is possible to provide a sufficient (e.g., a sufficiently long) data writing period and/or threshold voltage compensating period.

BRIEF DESCRIPTION OF THE DRAWINGS

The accompanying drawings, together with the specification, illustrate exemplary embodiments of the present invention, and, together with the description, serve to explain aspects and principles of the present invention.

DETAILED DESCRIPTION

Figure 1:
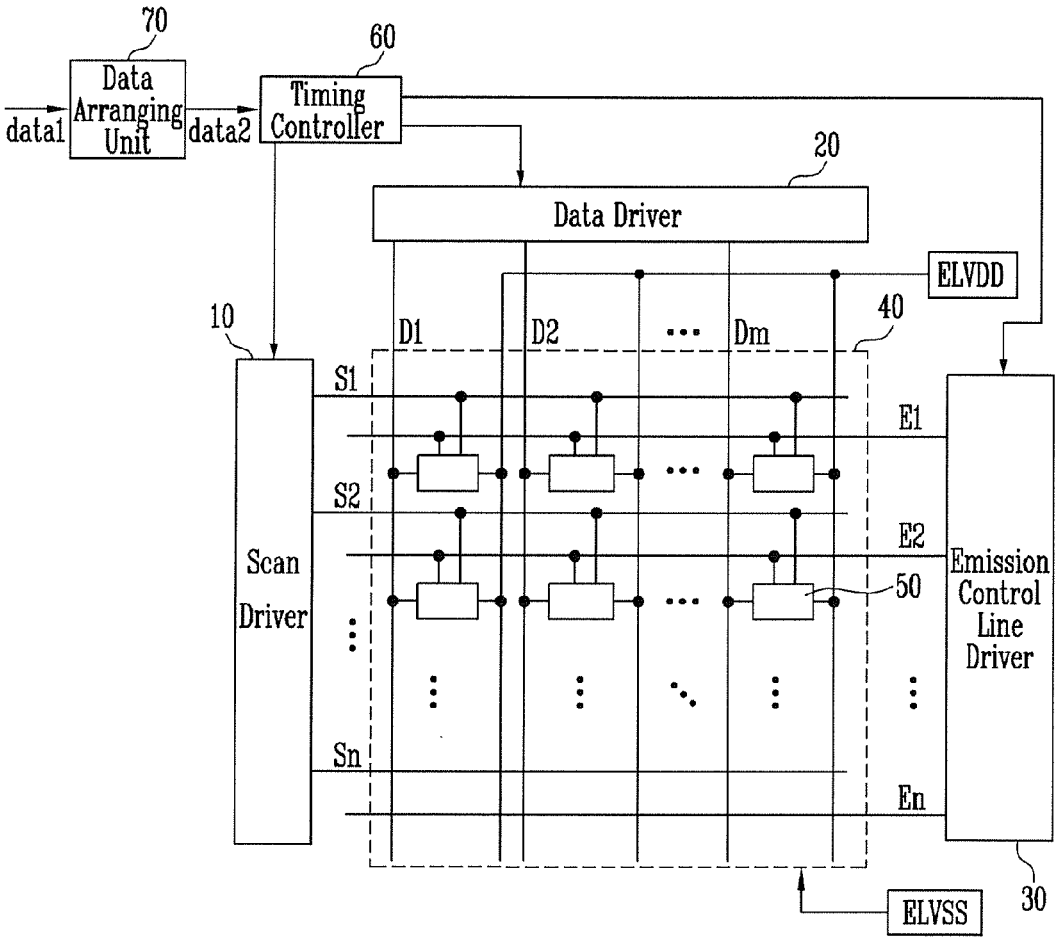
FIG. 1 is a schematic view illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled (e.g., connected) to the second element or indirectly coupled (e.g., electrically connected) to the second element via one or more third elements. Further, some of the elements that are not essential to a complete understanding of the invention are omitted for clarity. In addition, like reference numerals refer to like elements throughout.

In comparable organic light emitting displays, a method of adding a compensating circuit including a plurality of transistors and capacitors to each of the pixels has been suggested. The compensating circuit included in each of the pixels charges a voltage corresponding to the threshold voltage of the driving transistor to compensate for the variation in the driving transistor.

Such an organic light emitting display may be driven by, for example, a progressive emission method or a concurrent emission method. In both methods, data is input to the pixels sequentially by scan line. In the progressive emission method, the pixels sequentially emit light in units of horizontal lines in the same order as the input order of the data. In the concurrent emission method, the pixels concurrently (for example, simultaneously) emit light after the data is input to all of the pixels.

In the concurrent emission method, after the threshold voltage of the driving transistor and/or the data is stored in each of the pixels, all of the pixels concurrently (for example, simultaneously) emit light. In the concurrent emission method, the pixel structure is simplified. The concurrent emission method may be applied to various driving methods (for example, three-dimensional (3D) driving). In the concurrent emission method, the organic light emitting display is driven by a driving frequency of at least 120 Hz in order to lessen or prevent the generation of flicker.

However, when the driving frequency is set to at least 120 Hz, it may not be possible to provide a sufficient (e.g., a sufficiently long) threshold voltage and/or data wiring period. For example, when a panel includes 1,280 scan lines driven be a driving frequency of 120 Hz, the line time of each of the scan lines is limited to a maximum of only 6.5 μs (microseconds), which may be too short to provide a sufficient (e.g., a sufficiently long) threshold voltage compensating and/or data writing period (i.e., a period long enough to charge the corresponding pixel circuit capacitors to appropriate levels to perform the threshold voltage compensating and/or data writing).

Accordingly, organic light emitting displays and methods of driving the same according to embodiments of the present invention will be described in detail as follows with reference to FIGS. 1 to 4, in which embodiments by which those who skilled in the art may easily practice the present invention are included.

FIG. 1 is a schematic view illustrating an organic light emitting display according to an embodiment of the present invention.

Referring to FIG. 1, the organic light emitting display includes: a display unit 40 including pixels 50 positioned at crossing regions of scan lines S1 to Sn, data lines D1 to Dm, and emission control lines E1 to En; a scan driver 10 for driving the scan lines S1 to Sn; a data driver 20 for driving the data lines D1 to Dm; an emission control line driver 30 for driving the emission control lines E1 to En; a data arranging unit 70 for rearranging first data data1 supplied from the outside into second data data2; and a timing controller 60 for controlling the drivers 10, 20, and 30, and for transmitting the second data data2 to the data driver 20.

The display unit 40 includes the plurality of pixels 50 positioned at the crossing regions of the scan lines S1 to Sn and the data lines D1 to Dm. Each of the pixels 50 controls the amount of current supplied from a first power source ELVDD to a second power source ELVSS via an OLED (not shown) to correspond to a data signal to generate light of a particular brightness (for example, a predetermined brightness). The pixels 50 are concurrently (for example, simultaneously) set in an emission or non-emission state to correspond to emission control signals supplied to the emission control lines E1 to En.

The scan driver 10 supplies scan signals to the scan lines S1 to Sn. For example, in one embodiment, the scan driver 10 sequentially supplies scan signals to odd scan lines S1, S3, . . . , in odd-numbered frame periods (or odd frames) and sequentially supplies scan signals to even scan lines S2, S4, . . . , in even-numbered frame periods (or even frames). Accordingly, the data arranging unit 70 generates second data data2 (for driving pixels coupled to the odd scan lines in odd frames and to the even scan lines in even frames) using first data data1 (for driving all of the pixels every frame) supplied from the outside and supplies the generated second data data2 to the data driver 20 or the timing controller 60.

In further detail, the data arranging unit 70 generates one frame of the second data data2 using the corresponding two contiguous frames of the first data data1. For example, the data arranging unit 70 may generate the second data data2 by averaging the two contiguous frames of the first data data1. In addition, since the corresponding frame data for each of the pixels in each of the two contiguous frames are often the same or similar to each other, the data arranging unit 70 may delete one of the two frame's data of the first data data1 and may set the data of the frame that is not deleted to be the second data data2.

In addition, the data arranging unit 70 may directly supply data to the data driver 20 without passing through the timing controller 60. In this case, the data arranging unit 70 supplies the second data data2 corresponding to the odd scan lines to the data driver 20 in the odd frame periods and supplies the second data data2 corresponding to the even scan lines to the data driver 20 in the even frame periods.

It should be noted that the assignment of odd scan lines to odd frames and even scan lines to even frames is arbitrary. In other embodiments, the odd scan lines are driven during the even frames and the even scan lines are driven during the odd frames. Accordingly, throughout this application, "odd" and "even" are understood to denote the concept of alternating from one to the other in a sequential ordering. That is, the assignment of 2, 4, . . . , to "odd" and 1, 3, . . . , to "even" is an acceptable assignment of "odd" and "even" for purposes of this invention.

The timing controller 60 controls the scan driver 10, the data driver 20, and the emission control line driver 30. In addition, the timing controller 60 transmits the second data data2 to the data driver 20.

The data driver 20 generates data signals using the second data data2 and supplies the generated data signals to the data lines D1 to Dm. The data driver 20 supplies the data signals corresponding to the odd scan lines S1, S3, . . . , (that is, to the pixels in the odd scan lines) in the odd frame periods and supplies the data signals corresponding to the even scan lines S2, S4, . . . , (that is, to the pixels in the even scan lines) in the even frame periods. For example, when the scan signals are supplied in the odd frame periods in the order of the first scan line 51, the third scan line S3, . . . , the data driver 20 supplies the data signals corresponding to the first scan line S1, then the data signals corresponding to the third scan line S3, . . . .

The emission control line driver 30 supplies emission control signals (voltages by which some of the transistors included in a pixel, such as the emission control transistors, may be turned off) to the emission control lines E1 to En. The emission control line driver 30 supplies the emission control signals (so that the pixels 50 are set to be in the non-emission state) in the compensating/writing period of each frame and does not supply the emission control signals (so that the pixels 50 are set to be in the emission state) in the emission period of each frame.

In FIG. 1, it is illustrated that the emission control lines E1 to En are formed every horizontal line. However, the present invention is not limited to the above. For example, in other embodiments, one emission control line may be commonly coupled to all of the pixels 50. That is, according to embodiments of the present invention, the coupling type of the emission control lines E1 to En may be varied, for example, into any currently published coupling type.

Figure 2:
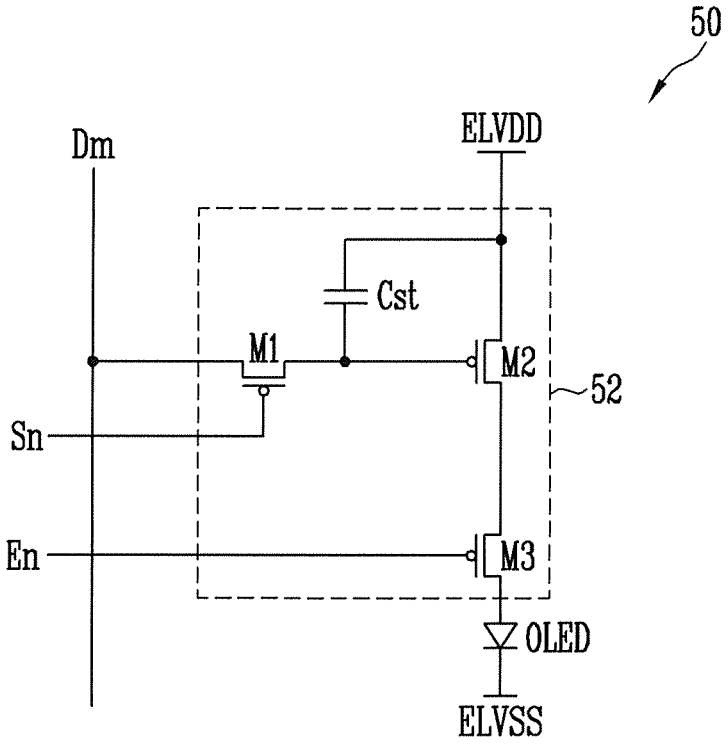
FIG. 2 is a circuit view illustrating a pixel according to an embodiment of the present invention.

FIG. 2 is a circuit view illustrating a pixel 50 according to an embodiment of the present invention. In FIG. 2, for convenience sake, the pixel 50 includes three transistors and one capacitor. However, the present invention is not limited to the above. In other embodiments according to the present invention, any currently published pixel type that is driven by the concurrent emission method may be selected for the pixel 50. For example, a pixel circuit 52 may include at least one additional transistor so that the threshold voltage of a driving transistor M2 may be compensated for. In the pixel circuit 52 illustrated in FIG. 2, the threshold voltage of the driving transistor M2 is not compensated for.

Referring to FIG. 2, the pixel 50 includes the OLED and the pixel circuit 52 for controlling the amount of current supplied to the OLED. The anode electrode of the OLED is coupled to the pixel circuit 52 and the cathode electrode of the OLED is coupled to the second power source ELVSS. The OLED generates light of a particular brightness (for example, a predetermined brightness) to correspond to the amount of current supplied from the pixel circuit 52.

The pixel circuit 52 controls the amount of current supplied to the OLED. In FIG. 2, the pixel circuit 52 includes a first transistor M1, a second transistor M2, a third transistor M3, and a storage capacitor Cst.

The first electrode of the first transistor M1 is coupled to the data line Dm and the second electrode of the first transistor M1 is coupled to the gate electrode of the second transistor M2. The gate electrode of the first transistor M1 is coupled to the scan line Sn. The first transistor M1 is turned on when a scan signal is supplied to the scan line Sn to electrically couple the data line Dm and the gate electrode of the second transistor M2 to each other.

The first electrode of the second transistor M2 (or the driving transistor) is coupled to the first power source ELVDD and the second electrode of the second transistor M2 is coupled to the first electrode of the third transistor M3. The gate electrode of the second transistor M2 is coupled to the second electrode of the first transistor M1. The second transistor M2 supplies the current (corresponding to the voltage coupled to the gate electrode thereof) to the OLED.

The first electrode of the third transistor M3 is coupled to the second electrode of the second transistor M2 and the second electrode of the third transistor M3 is coupled to the anode electrode of the OLED. The gate electrode of the third transistor M3 is coupled to the emission control line En. The third transistor M3 is turned off when an emission control signal is supplied to the emission control line En and is turned on when the emission control signal is not supplied.

The storage capacitor Cst is coupled between the gate electrode of the second transistor M2 and the first power source ELVDD. The storage capacitor Cst charges a voltage corresponding to a data signal.

Figure 3:
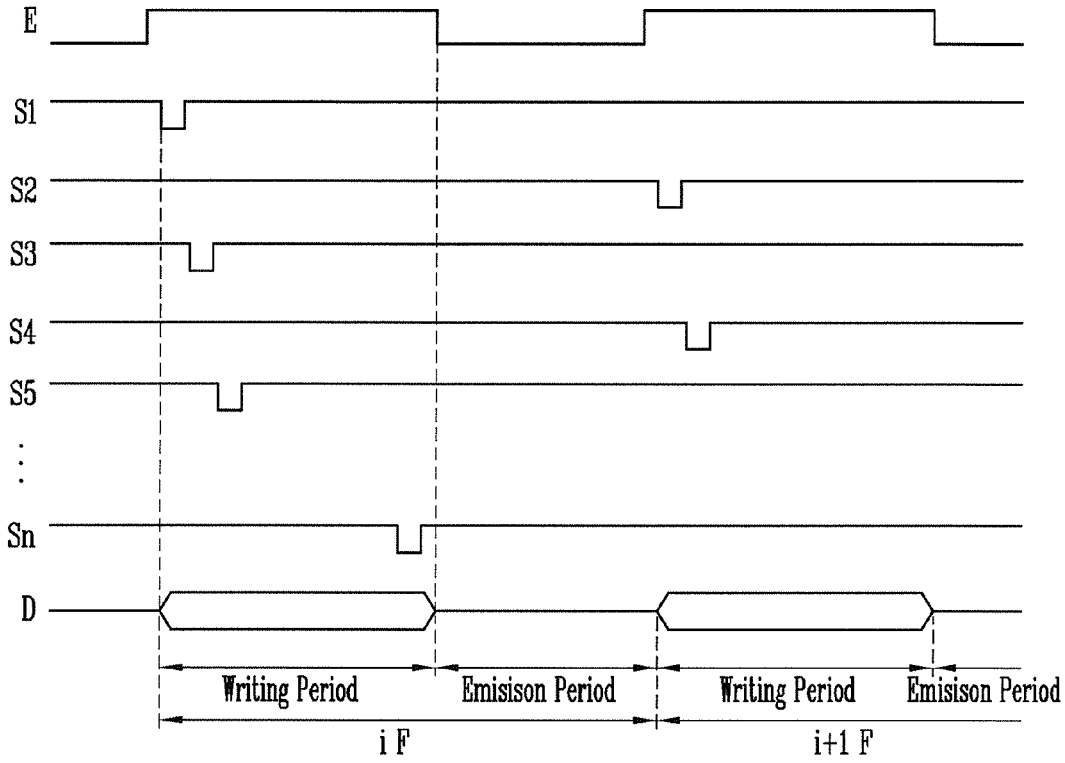
FIG. 3 is a waveform chart illustrating a method of driving an organic light emitting display according to an embodiment of the present invention.

FIG. 3 is a waveform chart illustrating a method of driving the organic light emitting display according to an embodiment of the present invention. In FIG. 3, for convenience sake, it is assumed that i is an odd number.

Referring to FIG. 3, each of the frames is divided into a writing period and an emission period (during which each of the pixels is driven). In the writing period, voltages corresponding to the data signals D are charged in the pixels 50. In addition, during the writing period, the threshold voltage of the driving transistor may be compensated for. In the emission period, light having particular brightness components (for example, predetermined brightness components) is generated to correspond to the data signals D supplied to the pixels 50.

Further, in the writing period, the emission control signals E are supplied to the emission control lines E1 to En so that the pixels 50 are in the non-emission state. In the emission period, the emission control signals E are not supplied to the emission control lines E1 to En so that the pixels 50 are set in the emission state to emit light.

In the writing period of the ith frame iF, the scan signals are sequentially supplied to the odd scan lines S1, S3, . . . . Data signals D are supplied to the data lines D1 to Dm to correspond to the scan signals supplied to each the odd scan lines S1, S3, . . . . At this time, since the scan signals are supplied to only the odd scan lines S1, S3, . . . , in the ith frame iF, the width of the scan signals supplied to the odd scan lines S1, S3, . . . , may be set to be larger than in a conventional driving method (e.g., a driving method where all of the scan lines sequentially receive the scan signals each frame). For example, when 1,280 scan lines are included in a display driven at 120 Hz, the line time of each of the scan lines can be set as high as 13 μs, which is sufficient time so that the threshold voltage of the driving transistor may be compensated and/or the data signals D may be charged.

In the emission period of the ith frame iF, the emission control signals E are not supplied to the emission control lines E1 to En. Therefore, each of the pixels 50 generates light of a brightness (for example, a predetermined brightness) to correspond to a corresponding one of the data signals. In addition, in the emission period of the ith frame iF, the pixels coupled to the even scan lines S2, S4, . . . , generate light corresponding to brightness components (for example, predetermined brightness components) to correspond to the data signals input in the writing period of the previous, that is, the (i−1)th frame.

In the writing period of the (i+1)th frame i+1F, scan signals are sequentially supplied to the even scan lines S2, S4, . . . . The data signals D are supplied to the data lines D1 to Dm to correspond to the scan signals supplied to the even scan lines S2, S4, . . . . At this time, since the scan signals are supplied only to the even scan lines S2, S4, . . . , in the (i+1)th frame i+1F writing period, the width of the scan signals supplied to the even scan lines S2, S4, . . . , may be set to be larger than in the conventional driving method.

In the emission period of the (i+1)th frame i+1F, the emission control signals E are not supplied to the emission control lines E1 to En. Therefore, each of the pixels 50 generates light of a particular brightness (for example, a predetermined brightness) to correspond to a corresponding one of the data signals. The pixels coupled to the odd scan lines S1, S3, . . . , in the (i+1)th frame i+1F emission period generate light having corresponding brightness components (for example, predetermined brightness components) to correspond to the data signals input in the writing period of the ith frame.

The driving waveform illustrated in FIG. 3 is for describing an embodiment of the present invention. The present invention is not limited to the above. For example, in another embodiment, the driving waveform supplies the scan signals to the odd scan lines S1, S3, . . . , in the writing period of the even frames and to the even scan lines S2, S4, . . . , in the writing period of the odd frames.

Figure 4:
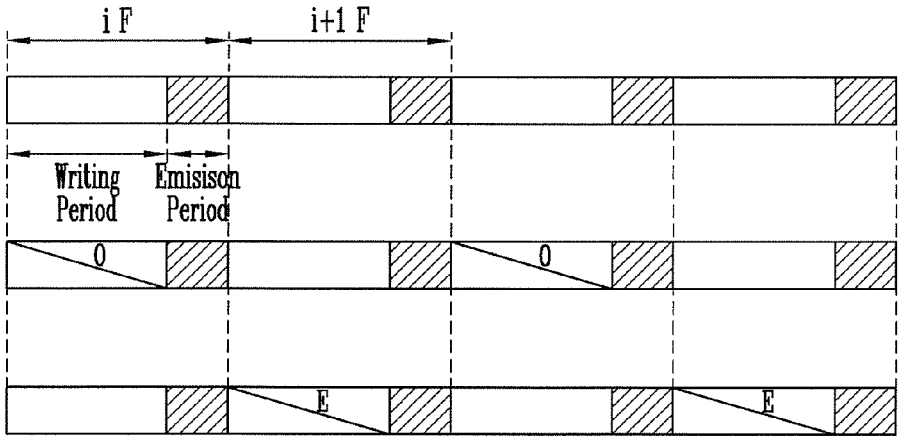
FIG. 4 is a timing view conceptually illustrating a method of driving an organic light emitting display according to an embodiment of the present invention.

FIG. 4 is a timing view conceptually illustrating a method of driving an organic light emitting display according to an embodiment of the present invention.

Referring to FIG. 4, one frame according to the present invention is divided into a writing period and an emission period. In the ith frame iF writing period, scan signals are supplied to the odd (O) scan lines S1, S3, . . . , and the data signals corresponding to the scan signals are supplied. In the emission period of the ith frame iF, the pixels coupled to the odd scan lines S1, S3, . . . , and the pixels coupled to the even scan lines S2, S4, . . . , emit light components to correspond to the data signals.

In the writing period of the (i+1)th frame i+1F, scan signals are supplied to the even (E) scan lines S2, S4, . . . , and the data signals corresponding to the scan signals are supplied. In the emission period of the (i+1)th frame i+1F, the pixels coupled to the odd scan lines S1, S3, . . . , and the pixels coupled to the even scan lines S2, S4, . . . , emit light components to correspond to the data signals.

That is, according to an embodiment of the present invention, in the ith frame iF writing period, scan signals are supplied to half of the scan lines included in the display unit 40 and, in the (i+1)th frame i+1F writing period, scan signals are supplied to the remaining half of the scan lines that do not receive the scan signals in the ith frame iF writing period. In this case, the width of the scan signals supplied to the scan lines in each of the frame periods may be sufficiently large to allow the threshold voltage of the driving transistor to be compensated for and/or the data signals to be stably charged in the pixels.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a scan driver for supplying scan signals to odd scan lines in a writing period of an odd frame where pixels are set to be in a non-emission state, and for supplying scan signals to even scan lines in a writing period of an even frame where the pixels are set to be in the non-emission state;

a data driver for supplying data signals corresponding to the odd scan lines in the writing period of the odd frame, and for supplying data signals corresponding to the even scan lines in the writing period of the even frame; and a data arranging unit for receiving two contiguous frames of first data, for generating one frame of second data using the two contiguous frames of the first data, and for supplying the generated second data to the data driver.

2. The organic light emitting display as claimed in claim 1, wherein the data arranging unit is configured to supply the second data corresponding to the odd scan lines to the data driver in the writing period of the odd frame, and to supply the second data corresponding to the even scan lines to the data driver in the writing period of the even frame.

3. The organic light emitting display as claimed in claim 1, wherein the data arranging unit is configured to generate the one frame of the second data by averaging the two contiguous frames of the first data.

4. The organic light emitting display as claimed in claim 1, wherein the data arranging unit is configured to select one frame of the two contiguous frames of the first data as the one frame of the second data.

5. The organic light emitting display as claimed in claim 1, wherein the pixels are set to concurrently be in the non-emission state when emission control signals are supplied to emission control lines, and are set to concurrently be in an emission state when the emission control signals are not supplied.

6. The organic light emitting display as claimed in claim 5, further comprising an emission control line driver for supplying the emission control signals to the emission control lines in the writing periods of the odd frame and the even frame, and for not supplying the emission control signals to the emission control lines in emission periods of the odd frame and the even frame.

7. A method of driving an organic light emitting display, comprising:

supplying scan signals to odd scan lines in a writing period of an odd frame set to be in a non-emission state; and supplying scan signals to even scan lines in a writing period of an even frame set to be in the non-emission state, wherein each of the pixels emits light during an emission period of each of two contiguous frames to correspond to a respective data signal supplied during the writing period of a first of the two contiguous frames.

8. The method as claimed in claim 7, further comprising:

supplying data signals corresponding to the odd scan lines in the writing period of the odd frame; and supplying data signals corresponding to the even scan lines in the writing period of the even frame.

* * * * *